United States Patent [19]

Kothe et al.

[11] Patent Number: 4,830,087

[45] Date of Patent: May 16, 1989

[54] CONTINUOUS CASTING OF THIN SLAB INGOTS

[75] Inventors: Dieter Kothe, Moers; Bernhard Krueger, Muelheim; Dietmar Lohse, Wesel; Gerd Moellers, Oberhausen; Fritz Pleschiutschnigg, Duisburg; Wolfgang Reichelt, Moers; Peter Vos-Spilker, Kempen; Elmar Wagener, Neukirchen-Vluyn, all of Fed. Rep. of Germany

[73] Assignee: Mannesmann AG, Duesseldorf, Fed. Rep. of Germany

[21] Appl. No.: 563,242

[22] Filed: Dec. 19, 1983

[51] Int. Cl.[4] ..... B22D 11/00

[52] U.S. Cl. ..... 164/460; 164/417; 164/476; 164/483

[58] Field of Search ..... 164/417, 418, 437, 438, 164/439, 443, 459, 460, 476, 477; 222/591, 592, 593

[56] References Cited

U.S. PATENT DOCUMENTS

| | | | |
|---|---|---|---|
| 2,835,940 | 5/1958 | Wieland | 164/438 |
| 3,333,452 | 8/1967 | Sendzimir | 164/476 |
| 3,604,598 | 9/1971 | Kappmyer et al. | 222/591 |
| 3,859,829 | 1/1975 | Krall et al. | 164/417 |
| 4,090,553 | 5/1978 | Beghin | 164/443 |
| 4,359,625 | 11/1982 | Okada et al. | 222/593 |

FOREIGN PATENT DOCUMENTS

| | | | |
|---|---|---|---|
| 56-109867 | 8/1981 | Japan | 164/437 |

*Primary Examiner*—Richard K. Seidel
*Attorney, Agent, or Firm*—Ralf H. Siegemund

[57] ABSTRACT

A method of continuous casting of ingots having a cross section with a high width to height or thickness ratio includes the steps of using a mold with a corresponding cross section and a casting pipe with bottom or near-bottom outlets and having laterally a minimum distance from the wall of the mold; preheating the casting pipe prior to casting to a temperature being at least approximately similar to the temperature of the metal later to be poured into the mold; initially closing the bottom outlet of the mold prior to startup; pouring molten metal into the mold for filling the mold up to a particular level while continuing heating the casting pipe; commencing withdrawal of an ingot from the mold along a curved path when the level of molten metal in the mold has reached the level of the outlet or outlets of the casting pipe.

9 Claims, 4 Drawing Sheets

CONTINUOUS CASTING OF THIN SLAB INGOTS

BACKGROUND OF THE INVENTION

The present invention relates to the continuous casting of slab ingots having basically rather thin dimensions in the direction commonly described as thickness; and more particularly the invention relates to a method, treatment, equipment and device for continuous casting of thin metal preferably steel slab ingots whereby basically an automatic startup as well as subsequent continuous casting proper under utilization of an appropriate mold is encompassed within the system in the general sense.

Thin slab ingots within the purview of the invention are basically a more or less flat casting or casting ingots amenable to coiling. The casting of thin ingots of this type is of course of interest because ingots are usually subsequently rolled down to flat sheet or plate stock and the thinner the original ingot or billet, the less working is needed subsequently. One can envision here, moreover, that the task at hand is to develop a casting process in which the ingot as it leaves the mold is, for example, less than 130 mm thick and as thin as 30 mm at a width range of 400–1600 mm. Generally speaking, it is of interest to choose a rectangular cross section with a very large width to height ratio and which approximates as much as possible the thickness of a final product such as a rolled plate or sheet stock. This subsequent rolling, either hot or cold rolling is to be minimized accordingly so that one can also say that the continuous casting of thin slab ingots provides flat billets which can immediately be fed into hot, broad width rolling mills without having to use blooming or slabbing mills.

The state of the art in this field is generally little more than experience so that at least theoretically it should be possible to cast thin slab ingots under the expectation that disadvantageous segregation and liquation occurs in the core of the casting and that in view of the known techniques of cooling, a solidification is to be expected which is low in dendrites However, the startup as well as during the pour procedure, new techniques, equipment and devices are needed.

DESCRIPTION OF THE INVENTION

It is an object of the present invention to provide a new and improved technique in terms of method and equipment for continuous casting of relatively thin and relatively wide ingots amenable to coiling.

In accordance with the preferred embodiment of the present invention, it is suggested to provide a mold for continuous casting with the appropriate flat rectangular cross section and to use a casting pipe, i.e. a tubular outlet spout through which the mold is charged which casting pipe will have a minimum distance, particularly from the long flat sides of the mold and which is heated prior to the commencement of casting to a temperature which is approximately the same as the temperature of molten metal which will subsequently pour into the mold. This heating is maintained at least until the mold is filled to some extent; during the onset of charging the mold, of course, the molten metal is capable of taking over the heating of the casting pipe and maintain its temperature. For purposes of heating, the casting pipe should include a heating element at least extending down to a level in which a bath of molten metal is maintained during subsequent steady state operation. Alternatively the casting pipe itself may be constructed as heating element. The mold is initially closed at the bottom but as it is filled extraction, i.e. ingot withdrawal will commence not later than upon attainment of a bath level in the mold being in the level of the outlets of the casting pipe.

In the case of continuously casting relatively thin and wide stock, the mold cavity is appropriately of narrow dimensions in one direction. In this case, it is possible that certain deposits are generated tending to bridge the space between the casting pipe and spout on one hand and the relatively closely spaced mold walls on the other hand. These bridges may consist for example, of alumina and the composition of this bridge may, in fact, result from certain decomposition processes which the casting pipe may undergo. The casting pipe is usually constructed from ceramic but even in case of a different composition there is a three-phase line, namely casting pipe, slag and metal, interfacing in close proximity of these materials is amenable to the formation of bridges. Therefore the spacing between the casting pipe and mold wall must be such that such bridge or bridges will not form particularly not during the onset of the casting as that would immediately tend to produce an interruption in the casting process right at the moment the casting actually begins.

It is a particular feature of the invention to avoid particularly during the onset phase, a rapid cooling of the molten metal near the pipe by means of which the mold is charged and here particularly the zones close to the mold wall. The heating process suggested here and extending well into the onset phase of casting avoids local temperature drop inside the mold. The invention here is particularly practicable in the case of aluminum quieted steel.

The onset of ingot extraction should be carried out automatically rather than manually, i.e. the extraction process should be timed automatically to the bath level inside the mold and should not be dependent upon manual intervention. This is particularly important because the interior of the mold is, of course, not directly observable but attaining a level equal to the discharged level o the casting pipe can be measured and determined so that an objective indication is established and used for the onset of ingot withdrawal.

As far as the charging of the mold is concerned, the prevention of growth bridging the casting pipe and the mold is one aspect and here the heating of the pipe as well as minimum space requirements are highly instrumental. However, it was found that if one uses gas issuing pipes, the steady state casting is also improved.

Subsequent working of the ingot depends to a considerable extent on the casting texture and the heat distribution in the cross section of the casting. Accordingly, it is suggested in furtherance of the invention to continue the extraction process in a curved path which directly leads into a coil; at some convenient place such as a low point, the casting being basically of an endless nature is cut into a suitable length commensurate with the desired coil size. This coiling can be carried out while the ingot is still hot but without entailment of damage to the casting texture. The overall curvature for the casting is suitably selected and may follow a program of controlled curvature radii. Depending upon the metal and the desired crystal structure, the curvature may change progressively in one direction or the other. Providing ingot withdrawal along a curved path with an end leading to a coiling device is also amenable to a rather compact overall design. In the case of slowed down (increase) radii of curvature, a bending device may be arranged just ahead to the coiler. The coils will be subsequently removed from the coiler, preferably preheated or better reheated before being moved to and fed into a rolling stand.

The ingot and casting should actually cool following extraction from the mold rather rapidly so that the roller track withdrawing the ingot should end from between two and eight meters from the outlet of the mold. The ingot extraction proper can, in fact operate already within the first quadrant of the curved ingot. Another aspect is the avoidance of external spray-water cooling of the ingot and casting. Cooling is obtained through rolls of the withdrawal track which are liquid cooled on and through the inside.

The casting pipe which dips into the mold should be made of a metal/ceramic material or a high melting metal such as tungsten, rhodium or tantalum or an alloy thereof or a metal oxide can be used in the form of a ceramic. The casting pipe should be of elongated cross section and the length extension of the interior cross section should be about twice the width thereof.

DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

Figure 1:
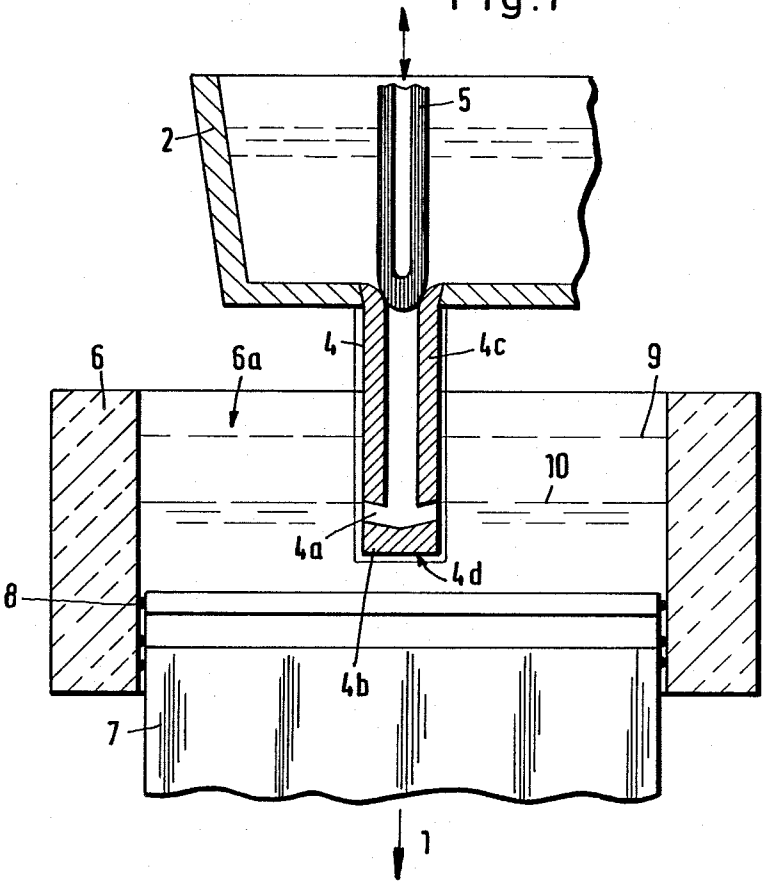
FIG. 1 is a longitudinal section view through equipment for continuous casting of thin slab ingots whereby an operational state is depicted which represents the startup procedure for continuous casting in accordance with the preferred embodiment of the invention upon practicing the best mode thereof.
Figure 2:
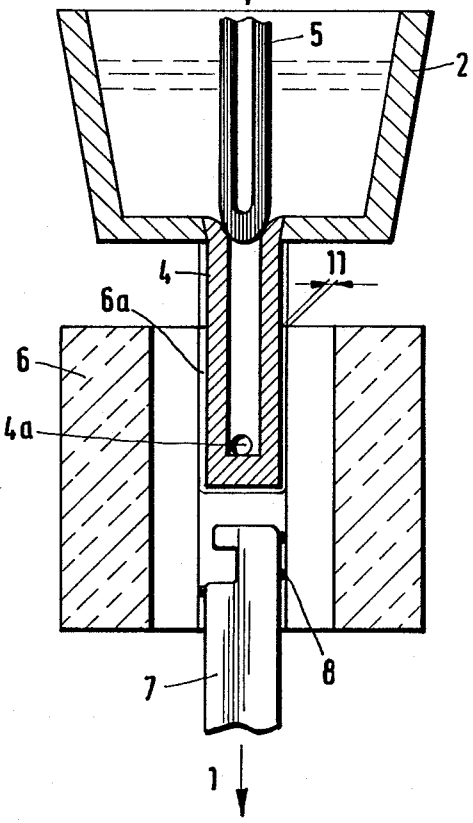
FIG. 2 illustrates a cross section similar to FIG. 1 but in a different section plane.

Proceeding now to the detailed description of the drawings, FIGS. 1 and 2 will serve to explain the method in accordance with the present invention. A casting path 1 is preceded by a storage vessel which receives molten metal from a ladle 3 (FIG. 5); the ladle provides adequate states of filling of the vessel 2. A casting pipe 4 extends from the bottom of vessel 2 and cooperates with a plunger or stopper 5 for opening and closing the casting pipe 4 or otherwise controlling the flow of molten metal in down direction. Them molten metal pours from the casting pipe 4 into the interior 6*a* of a mold 6. The mold 6 is basically of conventional construction except that the casting space or mold cavity has a very high length to width ratio. Ranges from 3 to 1, to 50 to 1, are envisioned here and in practice still larger ratios may be provided for. These ratios correspond to slab ingots thickness dimension in the range of 30 mm to 130 mm and a width from 400 mm to 1600 mm.

The startup of the casting requires an initial startup head or stool 7, and a flexible or rigid initial ingot which closes the mold 6 from below. This startup procedure is carried out as follows: The head 7 or stool is inserted in the mold from below and suitably sealed against the wall of the mold cavity by means of packing on sealing material 8. In the meantime the preheated vessel 2 is filled while the plunger 5 closes the casting pipe 7. Also, the pipe 4 is preheated to the temperature of the molten metal. The casting pipe is inserted into the mold cavity whereby particularly the laterally positioned outlets 4*a* will have a particular level 10 within the mold cavity which level is precisely spaced from the surface of molten metal to be maintained during regular casting That level is indicated with reference numeral 9. This level is critical for the transition from startup to ingot extraction from the mold.

The molten metal that is soon to fill the mold cavity must not solidify, particularly below the level 10. Also, there is a minimum distance 11 required within which solidification must not take place during the startup procedure. On the other hand, the casting pipe 4 must have a thickness so as to utilize the width (FIG. 2) of the cavity 6*a* as much as possible, because the pipe must withstand even the high thermal load during casting. Also, of course, this casting pipe must have a sufficiently large internal dimension to permit adequate amounts of feeding into the mold.

As the molten metal reaches in the mold cavity of level 10, this fact is measured and indicated because now the drive for the retraction mechanism and machine 12 has to be turned on. Concurrently, or with a slight time lead, the plug 5 is opened so that very quickly level 9 is attained within the mold. Now the continuous casting phase can begin which means that the rate of extraction of ingot material from below the mold 6 must balance the rate of feed flow of molten metal into the mold.

The casting or ingot 13 runs through the withdrawal path 14 and is coiled in station 15. After uncoiling the ingot may be annealed in a reheating furnace 16 before it is rolled in a wide rolling mill producing plate or sheet stock.

The ingot and casting withdrawal arrangement 14 is essentially comprised of several units of which so to speak the storage vessel 2 and the mold 6 constitute the input portions. An oscillating device 17 is provided below the mold in order to avoid sticking of the solidified skin to the mold surface. A curved withdrawal path in a frame 18 veers the casting into the horizontal whereby particularly the extraction drive 12 is provided when the ingot has reached the horizontal level. However, the ingot is not straightened into the horizontal but curves up again towards coiler 15.

Figure 3:
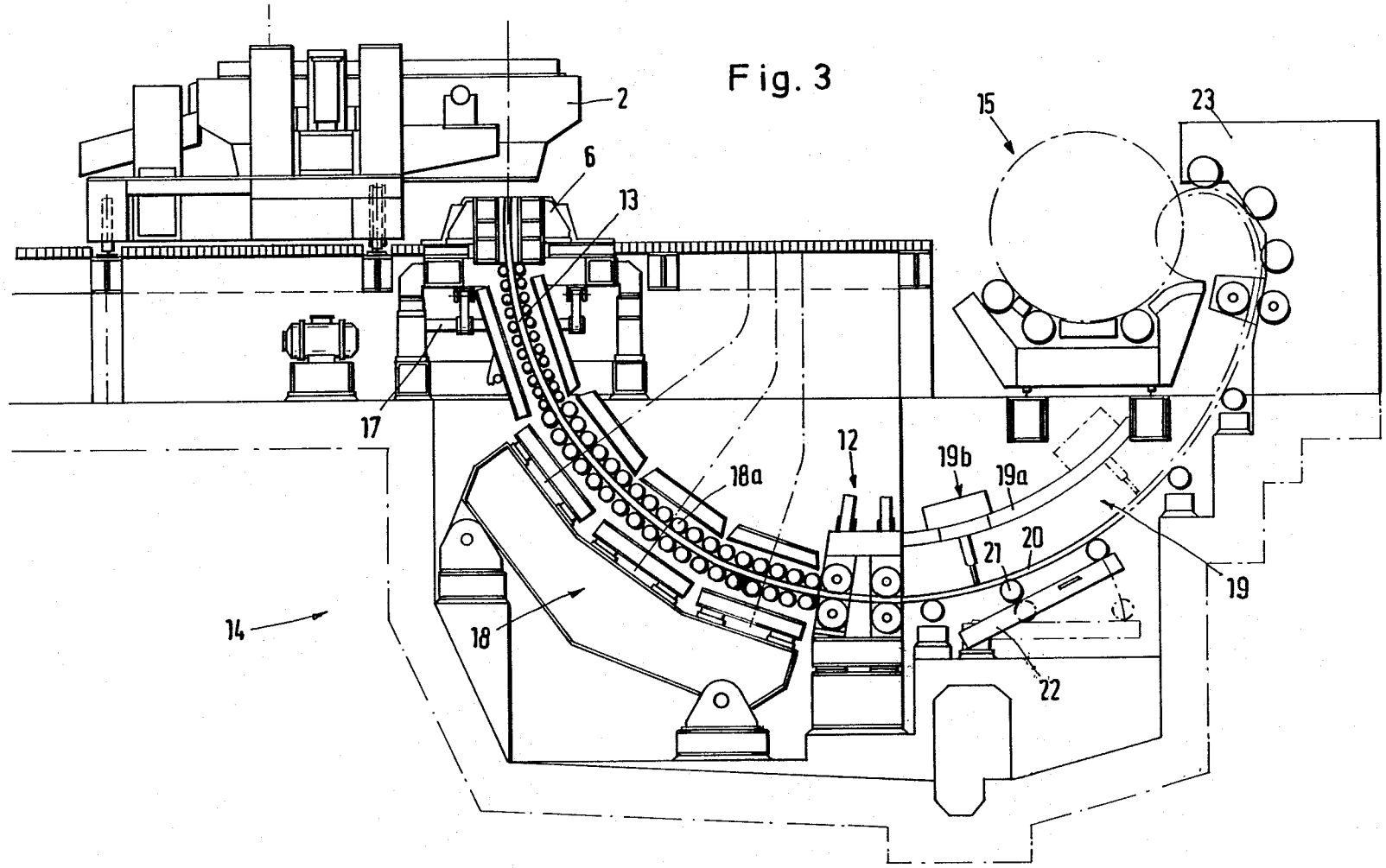
FIG. 3 is a side view of an entire continuous casting machine in accordance with the preferred embodiment and includes being further transverse cutting as well as coiling structure.

As shown additionally in FIG. 3, a transverse cutter 19 is provided downstream from the extraction machine 12. A rail track 19*a* is accordingly provided on the inside 20 of the curved ingot, its curvature being continued, and the torch cutters 19*d* are provided thereat. The support rolls 21 in the cutter range are preferably mounted of a pivotably supported carrier 22 and these rolls 21 can be quickly pivoted out of the way as the torch cutter 19*d* approaches.

The entire arrangement is basically of a compact design. This compactness, i.e. space and plate economy is enhanced by providing the coiling device 15 likewise on the inside 20 of the ingot's curvature. This aspect is of interest as the coiling procedure is, in fact, enhanced if the ingot is not straight. A bending stage 23 may be provided just ahead i.e. upstream from the coiler 15, to increase the curvature of the ingot for purposes of coiling.

The support structure and withdrawal track 18 ends just a little before a horizontal tangent is reached. Spray-water cooling is not required in all instances. For this reason the rolls 18*a* are cooled only from the inside and heat is therefore extracted from the ingot through these support and withdrawal rolls, i.e. through their roll jackets, and the cooling medium that flows in the inside of the support rolls.

Figure 4:
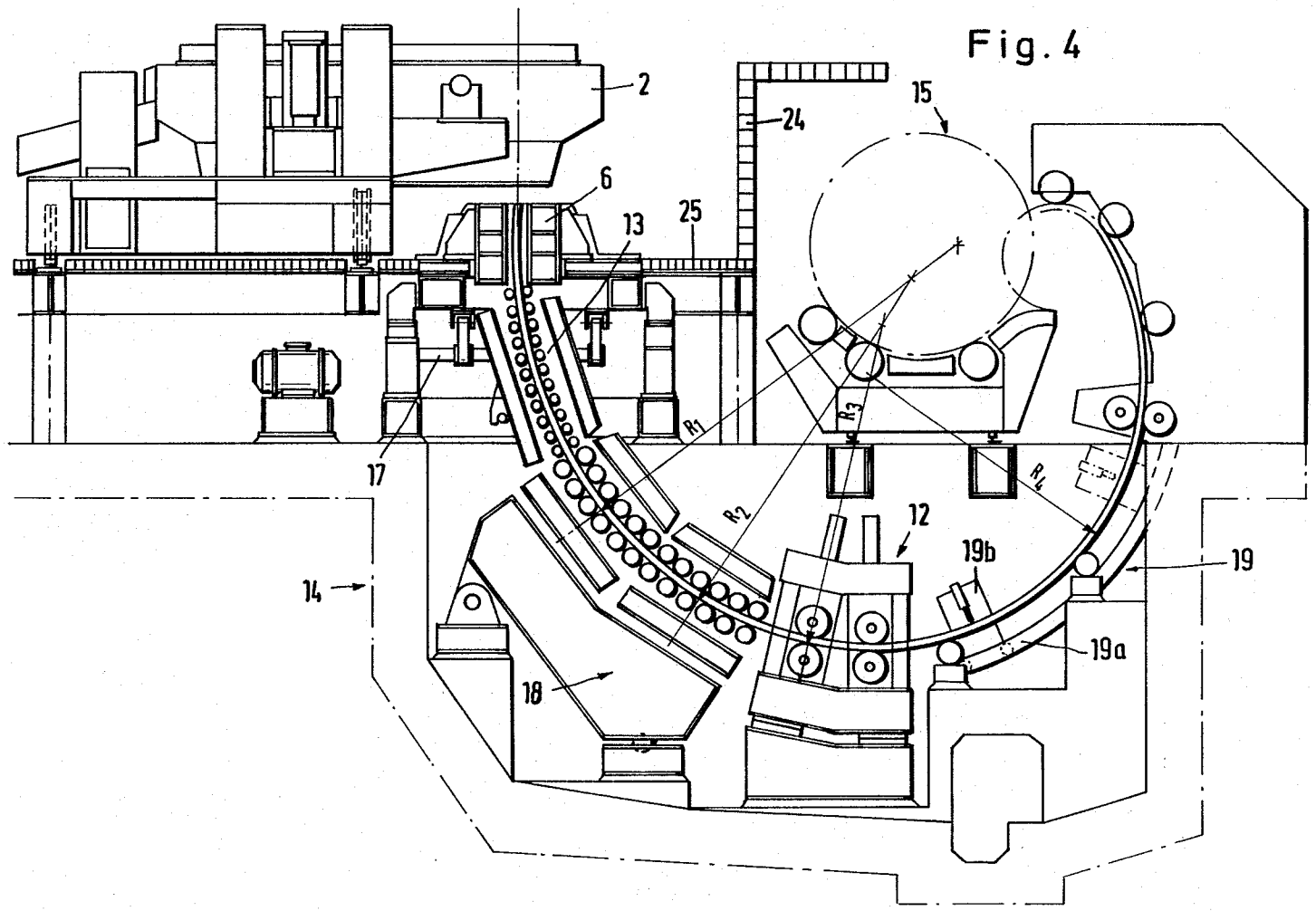
FIG. 4 is a side view similar to FIG. 3 but with modified casting equipment and FIG. 5 is a plan view of a large plant which includes a plurality of casting paths which operate in parallel, further showing auxiliary equipment and supplemental heating.

The example illustrated in FIG. 4 differs from the example shown in FIG. 3 through a positive progressive arc shaped travel path of the casting 1. The positive progression results from the transition and curvature defined by different radii. Particularly, the progression results from the progressive change in curvature from radius R1 to R2 to R3, and finally to R4. This change in curvature renders the equipment even more compact. It is of advantage here to place the track 19*a* on the outside of the curving so that the transverse cutter 19 is on the outside accordingly. Moreover, a partition 24 is provided between the casting arrangement proper 25 and the coiling equipment 15.

Figure 5:
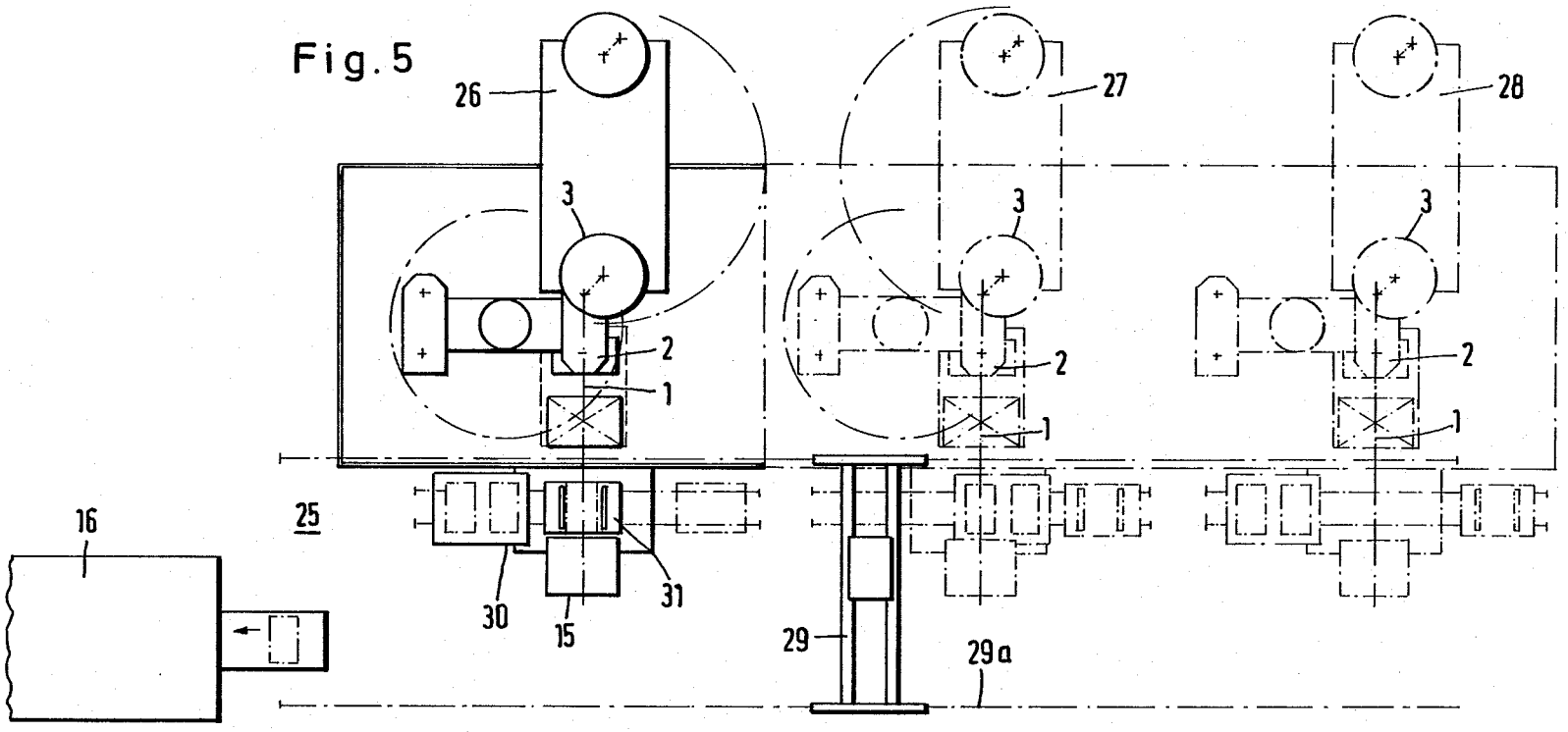

The elevation of a large equipment and plant shown in FIG. 5 illustrates three casting paths 1 for thin ingots 13. Accordingly, this system includes three storage vessels 2 cooperating with three molds and being respectively supplied with molten metal via three rotating towers for ladles 26 27 and 28 respectively. The casting equipment generally is also denoted with reference numeral 25 and includes a crane 29 which runs on track 29*a*. Each casting one is moreover associated with a coil carriage 30, a startup carriage 31 and a coiling equipment 15. The crane 29 transports the coiled thin ingots to a reheating furnace 16.

Turning for a moment to the casting pipe 4 shown in FIGS. 1 and 2, it can be seen that this particular type has a closed bottom 4*d* and upward slanting oppositely oriented outlet spouts 4*a*. The overall cross section of the casting pipe particularly in the range of the outlet spouts 4*a*, can be modified with plural lateral extension within the plane of longitudinal extension of the opening and duct as a whole. The walls 4*c* of the casting pipe may include heating wires, particularly in those portions of the wall which is above the bath level of molten material inside the mold. The will 4*c* down to the end 4*d* may have some electrical conductivity even though it is to be made of a highly refractory material. The refractory material may be a metal ceramic material or a high melting metal such as tungsten, rhodium, tantalum or alloys thereof. In the case of a ceramic, the wall may include about 20% graphite in order to impart certain electrical conductivity upon the casting pipe as a whole to serve as an electrically heatable and heating element.

The invention is not limited to the embodiments described above but all changes and modifications thereof not constituting departures from the spirit and scope of the invention are intended to be included.

We claim:

1. Method of continuous casting of ingots having a cross section with a high width to height or thickness ratio including the steps of:

using a mold with a corresponding cross section and a casting pipe with bottom or near-bottom outlets and having laterally a minimum distance from the wall of the mold;

preheating the casting pipe prior to casting to a temperature being at least approximately similar to the temperature of the metal later to be poured into the mold;

initially closing the bottom outlet of the mold prior to start-up;

pouring molten metal into the mold for filling the mold up to a particular level while continuing heating the casting pipe;

commencing withdrawal of an ingot from the mold when the level of molten metal in the mold has reached the level of the outlet or outlets of the casting pipe;

continuing withdrawing the ingot along a curved path; and coiling the ingot as withdrawn at the end of that curved path.

2. Method as in claim 1 and including the step of coiling the ingot and cutting it to particular length.

3. Method as in claim 1 and including the step of withdrawing the ingot over less than 90 degrees of curvature of a withdrawal path.

4. Apparatus and equipment for continuous casting of metal to obtain ingots the cross section of which has a large width to height or thickness ratio comprising:

a mold with appropriate rectangular cross section, there being a casting pipe for charging the mold with metal, the pipe having a minimum distance from the long sides of the walls of the mold;

ingot and casting-extraction means arranged underneath said mold to withdraw the ingot along a curved path, and for veering the casting from the vertical towards the horizontal;

a coiling device disposed at the end of said path for coiling the ingot on the inside of said curved path so that the coiling continues the initial curved veering of the ingot.

5. Apparatus as in claim 4 and including bending means disposed at the end of that curved path just at the entrance of the coiling means.

6. Apparatus as in claim 4 wherein said extracting means include support rolls with internal cooling.

7. Apparatus as in claim 4 wherein said casting pipe is made of a metal/ceramic material, a high melting metal, or of metal oxide.

8. Apparatus as in claim 4 wherein said casting pipe includes means for electrically heating the pipe at least in the range which will not be submerged in molten metal inside the mold.

9. Apparatus as in claim 8 wherein said casting pipe is constructed as electrical heating element and includes at least 20% graphite.

* * * * *